US009105431B2

(12) United States Patent
Sora

(10) Patent No.: US 9,105,431 B2
(45) Date of Patent: Aug. 11, 2015

(54) ELECTROMAGNETIC RELAY

(75) Inventor: Yosuke Sora, Yokohama (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 14/124,493

(22) PCT Filed: Mar. 8, 2012

(86) PCT No.: PCT/JP2012/056027
§ 371 (c)(1), (2), (4) Date: Dec. 6, 2013

(87) PCT Pub. No.: WO2012/176505
PCT Pub. Date: Dec. 27, 2012

(65) Prior Publication Data

US 2014/0092517 A1 Apr. 3, 2014

(30) Foreign Application Priority Data

Jun. 20, 2011 (JP) ..... 2011-136151

(51) Int. Cl.

| | |
|---|---|
| ***H01H 9/00*** | (2006.01) |
| ***H01H 50/44*** | (2006.01) |
| ***H01H 3/60*** | (2006.01) |
| ***H01H 47/04*** | (2006.01) |
| *H01H 50/16* | (2006.01) |
| *H01H 47/22* | (2006.01) |

(52) U.S. Cl.
CPC ..... *H01H 50/44* (2013.01); *H01H 3/60* (2013.01); *H01H 47/04* (2013.01); *H01H 47/22* (2013.01); *H01H 50/16* (2013.01)

(58) Field of Classification Search
USPC ..... 361/139, 144, 160
See application file for complete search history.

(56) References Cited

U.S. PATENT DOCUMENTS

| | | | | |
|---|---|---|---|---|
| 4,873,607 | A * | 10/1989 | Yamamoto | 361/210 |
| 6,323,562 | B1 * | 11/2001 | Renner et al. | 290/38 A |
| 6,752,111 | B2 * | 6/2004 | Osada et al. | 123/179.3 |
| 2004/0027776 | A1 | 2/2004 | Uotome et al. | |

FOREIGN PATENT DOCUMENTS

| | | | |
|---|---|---|---|
| CH | 211550 | A | 9/1940 |
| CN | 1248272 | C | 3/2006 |
| JP | 56096809 | A | 8/1981 |
| JP | 62-126528 | U | 8/1987 |
| JP | 08-031288 | A | 2/1996 |

(Continued)

OTHER PUBLICATIONS

Communication with extended European search report dated Feb. 13, 2015, from the corresponding European Patent Application No. 12802545.9.

*Primary Examiner* — Danny Nguyen
(74) *Attorney, Agent, or Firm* — Young Basile

(57) ABSTRACT

The present invention is provided with a fixed contact, a movable contact which selectively contacts with or separates from the fixed contact and a drive means which has at least an electromagnetic coil and drives the movable contact so that the movable contact comes into contact with the fixed contact. The drive means generates a first driving force for bringing the movable contact into contact with the fixed contact, and a second driving force larger than the first driving force for maintaining the contact state between the movable contact and the fixed contact.

5 Claims, 6 Drawing Sheets

(56) References Cited

FOREIGN PATENT DOCUMENTS

| | | | |
|---|---|---|---|
| JP | 2000082374 | A | 3/2000 |
| JP | 2003229043 | A | 8/2003 |
| JP | 2004022446 | A | 1/2004 |
| JP | 2004146096 | A | 5/2004 |
| JP | 2004207134 | A | 7/2004 |
| JP | 2005222870 | A | 8/2005 |
| JP | 2009158159 | A | 7/2009 |

* cited by examiner

ELECTROMAGNETIC RELAY

CROSS REFERENCE TO RELATED APPLICATION

The present application claims priority to Japanese Patent Application No. 2011-136151 filed on Jun. 20, 2011, which is incorporated herein in its entirety.

TECHNICAL FIELD

The present invention relates to an electromagnetic relay.

BACKGROUND

A starter solenoid switch such as that in JP Patent Publication No. 2004-207134 is provided with a plunger that is inserted into the inner diameter side of an exciting coil and opposes a fixed core with an air gap, a spring biasing the plunger in an anti-core direction, a fixed contact movable integrally with the plunger and, when sucked to the fixed core side upon energizing the exciting coil, comes into contact with the fixed contact to close a current supply circuit, and an elastic member mounted in the plunger to protrude toward a stopper surface side from an end surface of the plunger located on the anti-core side. When the plunger is sucked in the fixed core side and, due to disappearance of magnetic force, subsequently pushed back in the anti-core direction, since the elastic member abuts against the stopper surface, collision between the stopper surface and the counter-core end face of the plunger is avoided.

However, there is a problem that the collision energy generated between the fixed contact is large when the movable contact comes into contact with the fixed contact.

BRIEF SUMMARY

The problem which the present invention addresses is to provide an electromagnetic relay that can suppress the collision energy generated between the fixed contact and the movable contact.

The present invention solves the problem described above by providing a drive means that generates a first driving force for causing the movable contact to contact the fixed contact and a second driving force greater than the first driving force for holding the contact state.

According to the present invention, when the movable contact and the fixed contact are brought into contact, the contact pressure between fixed contact and the movable contact is reduced, and after the fixed contact and the movable contact has been contacted, the contact the pressure is increased. Therefore, it is possible to suppress the collision energy generated between the fixed contact and the movable contact.

BRIEF DESCRIPTION OF THE DRAWINGS

The description herein makes reference to the accompanying drawings wherein like reference numerals refer to like parts throughout the several views, and wherein.

DETAILED DESCRIPTION

Hereinafter, description is given of an embodiment according to the present invention with reference to the drawings.

Figure 1:
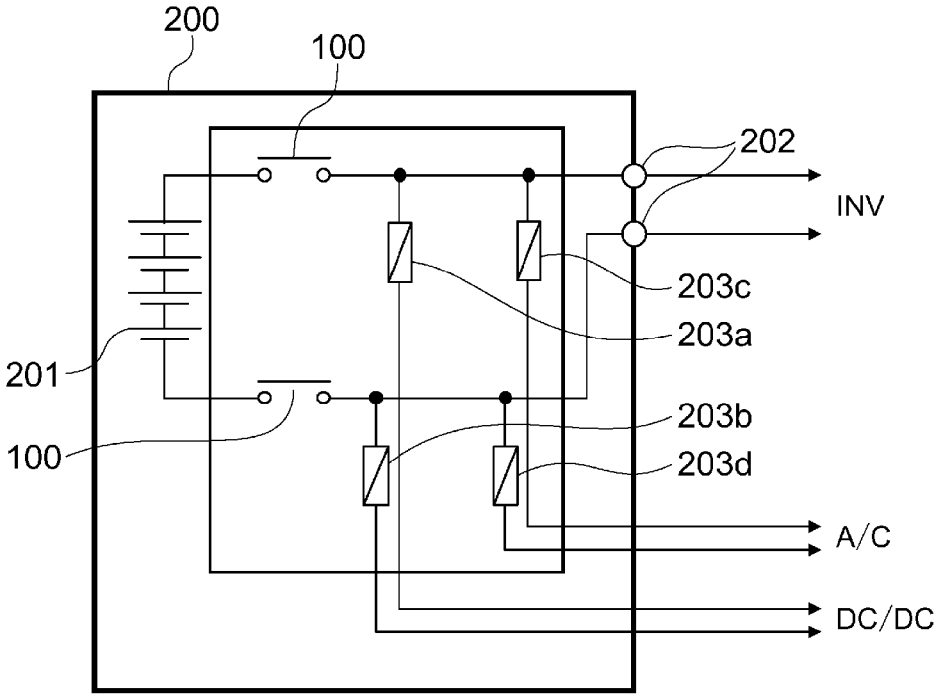
FIG. 1 is a block diagram showing a battery pack including a relay switch pertaining to an embodiment according to the present invention.

FIG. 1 is a block diagram illustrating a battery pack of a vehicle including an electromagnetic relay (hereinafter referred to as a relay switch) in an exemplary embodiment according to the present invention. For example, the relay switch 100 is used as a main relay for electric vehicles or hybrid vehicles. The relay switch 10 may be applied to other switches for the vehicle or even be applied to a switch used as ones for the purpose other than vehicle.

As shown in FIG. 1, the battery pack 200 includes a battery 201, a relay switch 100, a connector portion 202, and fuses 203*a*~203*d*. The battery 201 a drive source for driving the vehicle and is formed by connecting batteries such as secondary batteries or the like in series or in parallel. A relay switch 100 is respectively connected to a power supply line of the positive electrode side and the power supply line of the negative electrode side. Both the positive electrode side power supply line and the negative electrode side power supply line are connected to an inverter via a terminal 202. Both fuses 203*a*, 203*c* are connected to the positive electrode side power supply line, while both fuses 203*b* and fuse 203*d* are connected to the negative side power supply line. The battery 201 is connected with a DC/DC converter via the relay switch 100, the fuses 203*a*, 203*b*, while connected with an air conditioner (A/C) via the relay switch 100, the fuse 203*c* and the fuse 203*d*.

Figure 2:
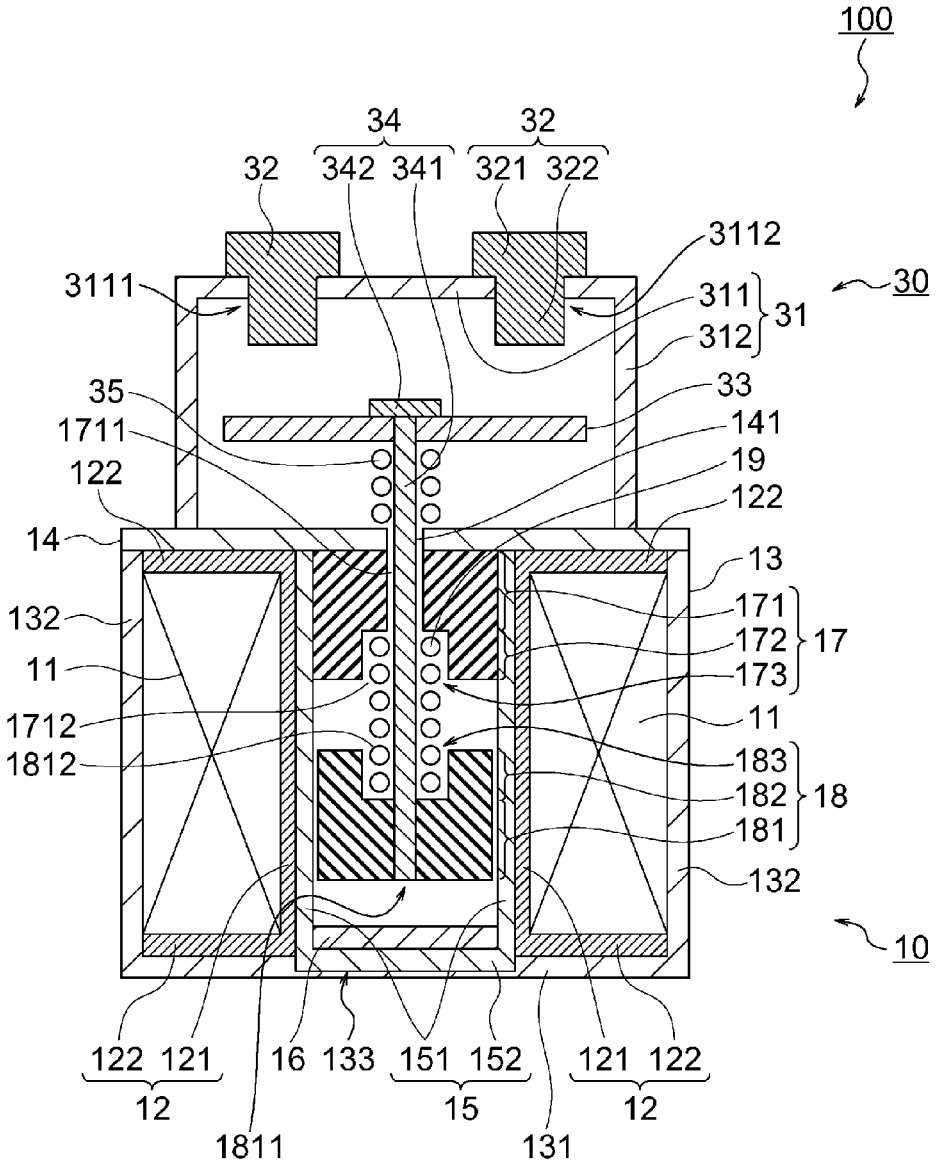
FIG. 2 is a cross-sectional view of the relay switch in FIG. 1.

Now, a specific configuration of the relay switch 100 will be described with reference to FIG. 2. FIG. 2 is a cross-sectional view of the relay switch 100. As shown in FIG. 2, the relay switch 100 is provided with a driver portion 10 and a contact portion 30.

The driver portion 10 is provided with a coil 11, a bobbin 12, a housing portion 13, a top plate 14, a plunger cap 15, a rubber damper 16, a fixed iron core 17, a movable iron core 18, and a return spring 19. As will be described later, by driving the shaft 34 in the axial direction (vertical direction in FIG. 2), the drive unit 10 functions as a member to cause the movable contact 33 and the fixed contact 32 to selectively contact with and separate from each other.

The coil 11 is formed in a cylindrical shape by winding a plurality turns of coil and generates a magnetic flux upon a current being supplied. The bobbin 12 is a member for holding the coil 11 and provided with a cylindrical wall portion 121 and a pair of plate portions 122 extending outwardly and vertically from both ends of the cylindrical wall portion 121. The coil 11 is sandwiched by the pair of the plate portions 122, 122. The coil 11 is coupled to a control circuit (not shown) and generates a magnetic flux outputted from the control circuit.

The housing portion 13 is formed into a bottomed cylindrical shape, and provided with a bottom portion 131 and a wall portion 132 extending in the vertical direction of the bottom surface 131 with the direction facing the bottom surface portion 131 open.

Further, the central portion of the bottom portion 131 is provided with a recess 133. The housing portion 13 is formed of a magnetic material of a metal such as iron. The top plate 14 is formed in a cylindrical shape. The central portion of the upper plate portion 14 is formed with a through hole 141 for passing a shaft which will be described later. The upper plate 14 is formed of magnetic material and serves as a lid portion of the housing portion 13 to cover the opening of the housing portion 13 from the direction opposed to the bottom surface portion 131, and fixed to the side wall 132 by caulking and the like.

The plunger cap 15 is formed into a bottomed cylindrical shape and includes a cylindrical portion 151 of cylindrical shape and a bottom portion 152 that covers the bottom surface of the cylindrical portion 151. The plunger cap 15 is press-fitted into the hollow portion covered with the wall portion 121 of the bobbin 12 and the recess 133 to be assembled to cover the recess 133 and the inside of the wall portion 121. Thus, the coil 11 and the bobbin 12 are accommodated by the housing portion 12, upper plate 14 and the plunger cap 15. Further, a rubber dumper 16 is provided on the upper surface of the bottom portion 152 of the plunger cap 15, and the rubber dumper 16 is formed of elastic member in a cylindrical shape. The rubber dumper 16 is provided to absorb the collision energy between the movable iron core 18 and the plunger cap 15.

The fixed core 17 is formed by a cylindrical portion 171 integrally with a cylindrical portion 172 with the same outer periphery of the cylindrical portion 171. The cylindrical portion 171 and the cylindrical portion 172 are disposed coaxially, each being provided with an insertion hole 1711, 1721 in each axis for inserting a shaft 34 to be described later. The outer wall surface of the cylindrical portion 171 and the outer wall surface of the cylindrical portion 172 are formed so as to be flush with each other, and the diameter of the insertion hole 1712 is formed to be larger than the diameter of the insertion hole 1711. Thus, the fixed core 17 is formed with a recess 173 which is recessed toward the upper side from the bottom surface of the cylindrical portion 172. For example, the fixed iron core 17 is formed by laminating steel plates of a metal such as iron. The fixed core 17 is press-fitted into the inside of the cylindrical portion 152 of the plunger cap 15 and is in close contact with the top of the plunger cap 15. Further, the diameter of the insertion hole 1711 is formed to be larger than the diameter of the axial portion 341 of the shaft 34 so that a gap is formed between the inner surface of the cylindrical portion 171 and the surface of the axial portion 341 of the shaft 34. Thus, the inner surface of the cylindrical portion 171 serves as a sliding surface for sliding the shaft 34.

The movable core 18 is formed by a cylindrical portion 181 integrally with a cylindrical portion 182 with the same outer periphery of the cylindrical portion 181. The cylindrical portion 181 and the cylindrical portion 182 are disposed coaxially, each being provided with an insertion hole 1811, 1812 in each axis for inserting a shaft 34 to be described later. The outer wall surface of the cylindrical portion 181 and the outer wall surface of the cylindrical portion 182 are formed so as to be flush with each other, and the diameter of the insertion hole 1812 is formed to be larger than the diameter of the insertion hole 1811. Thus, the movable core 18 is formed with a recess 183 which is recessed toward the lower side from the upper surface of the cylindrical portion 183. For example, the movable iron core 18 is formed by laminating steel plates of a metal such as iron. The movable core 18 is inserted into a cylindrical portion 152 of the plunger cap 15. Further, the diameter of the outer periphery of the movable core 18 is formed to be smaller than a diameter of a driving portion of the cylindrical portion 152. A gap is formed between the outer surface of the movable core 18 and the inner surface at the lower portion of the cylindrical portion 152. Further, the tip portion of the shaft 34 is press-fitted into an insertion hole 1811 of the cylindrical portion 181 so that the tip portion of the shaft 34 and the cylindrical portion 181 are fixed to each other. Thus, the outer surface of the movable core 18 serves as a sliding surface with respect to the inner surface of the plunger cap 15. The magnetic circuit is formed by the housing 13, the upper plate 14, the fixed iron core 17 and the movable iron core 18.

A return spring 19 is an elastic member of a coil shape having an inner diameter greater than the outer diameter of the shaft portion 341 of the shaft 34 provided coaxially with the central axis of the shaft portion 341. The shaft 34 is inserted into a cavity part of the return spring. By fitting the upper end portion of the return spring 19 into the recess 173 and the lower end portion of the return spring 19 into the recess 183, respectively, the return spring is respectively fixed to both the movable iron core 18 and the fixed core 17. The return spring 19 urges the movable core 18 in a direction which deviates movable contact 33 from the fixed contact 32.

A contact portion 30 includes a base block 31, a pair of fixed contacts 32, a movable contact 33, a shaft 34, and a contact pressure spring 35.

The base block 31 is formed in an insulating member of rectangular shape, and provided with a top plate 311 and a wall portion 312 extending vertically from the end of the top plate 311 with the direction facing the top plate 311 open. The top plate 311 is formed with insertion holes 3111, 3112 for insertion of the pair of the fixed contacts 32. The lower end of the wall portion 312 is fixed to the upper plate 14. Further, the movable contact 33 and the upper portion of the shaft 34 are accommodated within a space defined by the top plate 311, the wall portion 312, and the upper plate 14.

The fixed contact 32 is formed of a conductive material such as copper, for example, and formed by a cylindrical portion 321 and a cylindrical portion 322 integral with the cylindrical portion 321 having the outer periphery smaller than the outer periphery of the cylindrical portion 321. The outer periphery of the cylindrical portion 322 is formed slightly larger than the insertion holes 4111, 3112 provided in the top plate 311. With respect to the fixed contact 32, the lower cylindrical portion 322 is inserted in the insertion holes 3111, 3112 of the top plate 311 while the cylindrical portion 321 is fixed to the base block 31 with the cylindrical portion 321 projecting outwardly from the base block 31. The base surface of the cylindrical portion 322 serves a contact portion with the surface of the movable terminal 13.

The movable contact 33 is formed of a conductive material such as copper of a plate shape, for example. An insertion hole is provided at the center of the movable contact 33 for inserting the shaft 34. By inserting the shaft 34 into the insertion hole, the movable contact 33 is fixed to the shaft 34. The upper surface of the movable contact 33 provides a contact with the fixed contact 32.

The shaft 34 is formed by a non-magnetic material and includes a rod-shaped shaft portion 341 and a bearing portion 342 provided at one end of the shaft portion 341. The shaft portion 341 is inserted in the insertion hole at the center of the movable contact 33 and into the insertion holes 1811, 1812 at the center of the movable core 18 so as to be fixed to both the movable contact 33 and the movable core 18. Further, the shaft portion 341 is movably inserted in the inner cavity portion of the movable contact 33, the insertion hole 141 at the center of the upper plate 14, the insertion holes 1711, 1712 at the center of the fixed core 17, and the inner cavity portion of the return spring 19. The bearing portion 342 is formed with its outer diameter larger than the diameter of the insertion hole of the movable contact 33 and fixed to the movable 33. The shaft 34 is movable in the axial direction of the central axis of the shaft portion 341 (in the vertical direction in FIG. 2) in response to the ON and OFF operation of the relay switch 100 so that the axial direction of that central axis represents a moving direction of the movable contact 33 and the movable core 18.

The contact pressure spring 35 is an elastic member of coil having an inner diameter greater than the outer diameter of the shaft portion 341 of the shaft 34 provided coaxially with the central axis of the shaft portion 341. The contact pressure spring 35 is disposed between the movable contact 33 and the upper plate 14. The contact pressure spring 35 biases the movable contact 33 in a direction of contact of the movable contact with the fixed contact 32.

Now, description will be given of the operation of the relay switch 100 with reference to FIG. 2. In a state where no current is applied to the coil 11, the fixed contact 32 and the movable contact 33 are opposed with a gap in between. First, from the state in which the fixed contact 32 and the movable contact 33 are separated from each other, a contact current (I1) is supplied to the coil 11. The contact current (I1) is the minimum current that is allowed to drive the shaft 34 is set to establish at least a partial contact between the movable contact 33 and fixed contact 32. The contact current (I1) is lower than a holding current (I2) described below and does not present a sufficient current value to continuously hold the ON state of the relay switch 100.

When contact current (I1) flows and the coil 11 is energized, the movable iron core 18 is attracted to the fixed core 17 and the shaft 34 fixed to the movable iron core 18 is driven in the axial direction of the shaft portion 341 to cause the movable contact 33 to contact the fixed contact 32. Then, after a control circuit (not shown) connected to the coil 11 has confirmed the continuity of the coil 11 by detecting a voltage or the like of the wiring between the coil 11 and the control circuit, the holding current (I2) is caused to flow. Note that the holding current (I2) is a previously set current to hold the contact state between the fixed contact 32 and the movable contact 33. The holding current (I2) is a current higher than the contact current (I1), and by strengthening the contact between the fixed contact 32 and the movable contact 33 to continuously hold the ON state of the relay switch. When the holding current (I2) flows through the coil 11, since the contact pressure between the fixed contact 33 and movable contact 33 becomes large compared to the contact pressure when the contact current (I1) passes through the coil 11. Thus after the movable contact 33 has contacted the fixed contact 32, the holding force of the movable contact 33 and fixed contact 32 is increased.

Specifically, in the present embodiment, when turning on the relay switch 100, the contact current (I1) is flown in the coil 11 and impart a small driving force (P1) to the shaft 34 to bring the fixed contact 32 into contact with the moving contact 33 while holding the contact pressure between the fixed contact 32 and the movable contact 33 small. When turning on the relay switch 100, the vehicle is stopped so that the vibrations exerted on the relay switch 100 is small. Thus, it suffices when the fixed contact 32 and the movable contact 33 are in contact with each other, and no large driving force is required. Thus, in the present embodiment, when turning on the relay switch 100, the movable contact 32 is driven under a small driving force.

Then, after the fixed contact 32 and the movable contact 33 have come into contact with each other, the coil 11 is supplied with the holding current (I2) so that, by adding a large driving force (P2) larger that the driving force (P1) to the shaft 34, the contact state between the fixed contact 32 and the movable contact 33 is held while maintaining the contact pressure large between the fixed contact 32 and the movable contact 33. After the fixed contact 32 and the movable contact 33 have been brought into contact, it is possible that a large vibration is added to the relay switch 100 when the vehicle starts to move. Thus, in order to prevent the fixed contact 32 from being separated from the movable contact 33, a large driving force toward the shaft 34 is required. Thus, in the present embodiment, after the relay switch has been turned on, the moving contact 33 will be driven under a large driving force (P2).

On the other hand, when stopping the energization of the coil 11, the movable contact 33 is deviated from the fixed contact 32 from the state in which the movable contact 33 and fixed contact 32 are in contact by the return spring 19, so that the relay switch 100 become off.

As described above, in the present embodiment, by setting a current to be supplied to the coil 11 so as to allow to magnetize the fixed core 17 and the movable core 18 to drive the shaft 34 so that the movable contact 33 will come into contact with the fixed contact 32. In order to turn the relay switch on, when driving the movable contact 33, the movable contact 33 and the fixed contact 32 are caused with contact each other by the driving force (P1) while the movable contact 33 and the fixed contact 32 are held in contact condition by the driving force (P2). Thus, when the movable contact 33 and the fixed contact 32 are brought into contact each other, the contact pressure will be small between the movable contact 33 and the fixed contact 32. After the movable contact 33 and the fixed contact 32 have been brought into contact, the contact pressure will be caused to be increased. Thus, when turning on the relay switch 100, it is possible to suppress the collision energy generated between the movable contact 33 and fixed contact 32.

Incidentally, unlike the present embodiment, in order to contact the fixed contact 32 and movable contact 33 from the state in which the fixed contact 32 and movable contact 33 are deviated, when the movable contact 33 is allowed to be driven by driving the shaft under a large force, at both the contact point between the movable contact 33 and the fixed contact 22 and the movable core 18 and the fixed core 17, during the collision, in some cased a large noise is generated or the life of the contact portion or shortened.

Further, in the case of providing an elastic body between the movable contact and the fixed contact 32, because the elastic modulus of the elastic body changes depending on ambient temperature and external deterioration of the elastic body, it is likely impossible to reduce the collision energy.

On the other hand, in the present embodiment, when turning on the relay switch 100, the movable contact 33 and the fixed contact 32 are brought into contact under the driving force (P1), and the contacted condition between the movable contact 33 and the fixed contact 32 is held by the driving force (P2). Therefore, at both the contact point between the movable contact 33 and the fixed contact 22 and the movable core 18 and the fixed core 17, during the collision energy is reduced to prevent noise at the contact portion with wear being suppressed as well.

Further, after the fixed contact 32 is in contact with the movable contact 33, to hold the contact between the fixed contact 32 and movable contact 33 driving force (P2) is applied. Thus, for example, it is possible to prevent the contact portions to separate due to the vibration or shock that are received while the vehicle is running. As a result, it is possible to prevent such situation from occurring in which the increase in the contact portion or adhesion of the contacts is encountered associated with separation of the contact portions.

Also, in the present embodiment, by causing the contact current (I1) to flow in the coil 11, the driving force (P1) is generated, while by allowing the holding current (I2) to flow in the coil 11, the driving force (P2) is produced. Thus, by changing the current value to be supplied to the coil 11, the driving force (P1) and the driving force (P2) are subject to selective production, at least one coil is needed to be provided so that it is possible to suppress the cost of the relay switch 100.

Note that the structure comprising at least a coil 11 and pertaining to a fixed core 17 and a movable core 18 corresponds to the "driving means" according to the present invention. The coil 11 corresponds to the "electromagnetic coil", the driving force (P1) to the "first driving force", the driving force (P2) to "the second driving force", the contact current (I1) to "the first current", and the holding current (I2) to "the second current", respectively.

Figure 3:
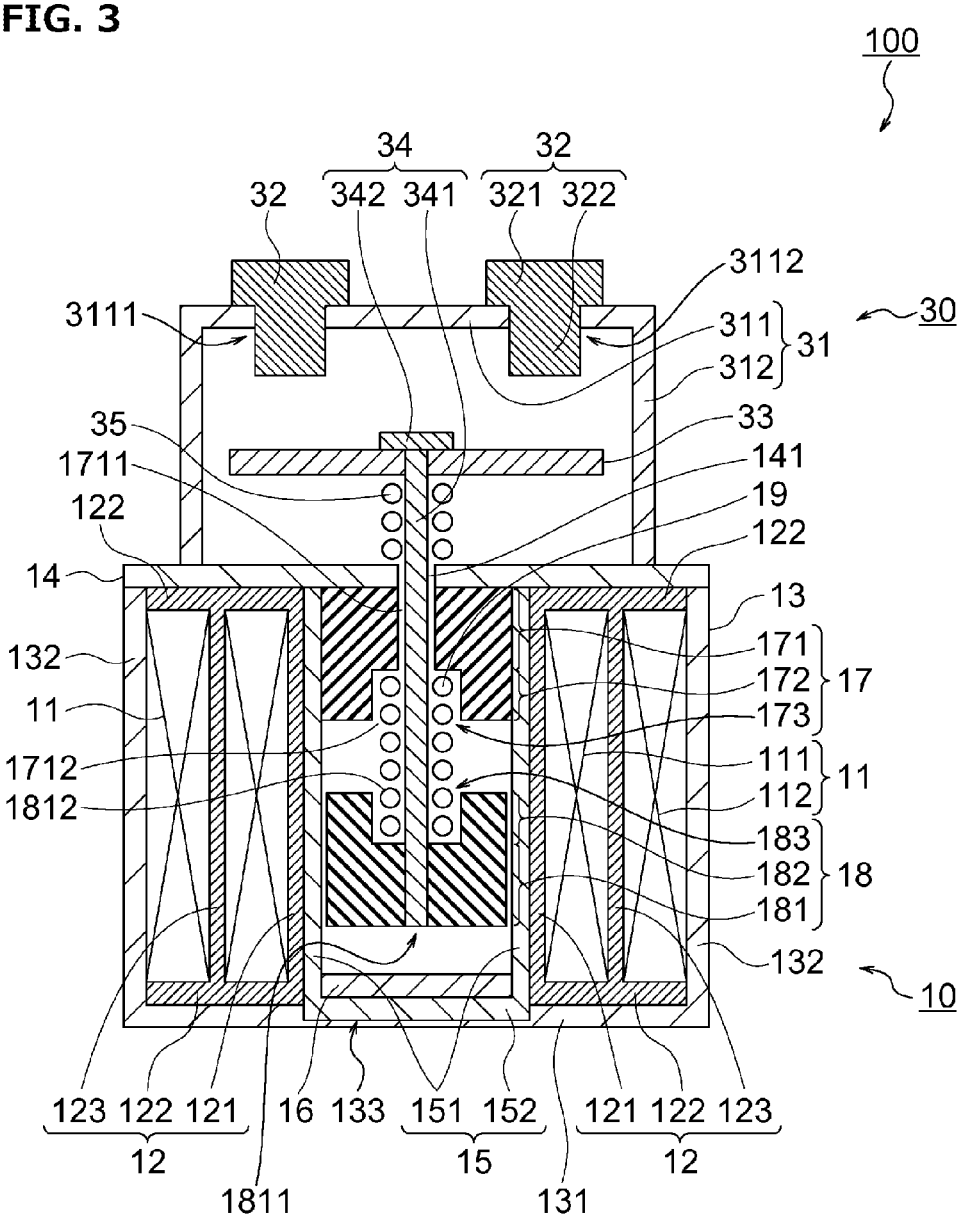
FIG. 3 is a cross-sectional view of the relay switch pertaining to another embodiment according to the present invention.

FIG. 3 is a cross-sectional view of the relay switch 100 according to another embodiment of the present invention. Compared to the first embodiment described above, the configuration in the second embodiment is different in both the coil 11 and the bobbin 12. Since the structure other than these is the same as the first embodiment, the description thereof will be incorporated the description, when appropriate.

As shown in FIG. 3, the coil 11 is provided with a coil 111 and a coil 112. The coil 111 and the coil 112 are disposed so that each axis is aligned with the axis of the shaft portion 341 of the shaft 34. The coil 111 is disposed inside the coil 112 and is sandwiched between the wall portion 121 and the wall portion 123. The coil 112 is sandwiched between the wall portion 123 and the wall portion 132 of the cylindrical portion 13. Each length of the coil 111 and the coil 112 are formed to be equal in the axial length of the coil 111 and the coil 112.

The bobbin 12 includes a wall portion 121, a pair of plate portion 122, and a wall portion 123. Between the pair of wall portions 123, the wall portion 123 is disposed so as to be parallel to the wall portion 121. Between the wall portion 121 and wall portion 123, a space is provided to accommodate the coil 111, while between the wall portion 123 and the wall portion 132, a space for receiving the coil 112 is provided.

Figure 4:
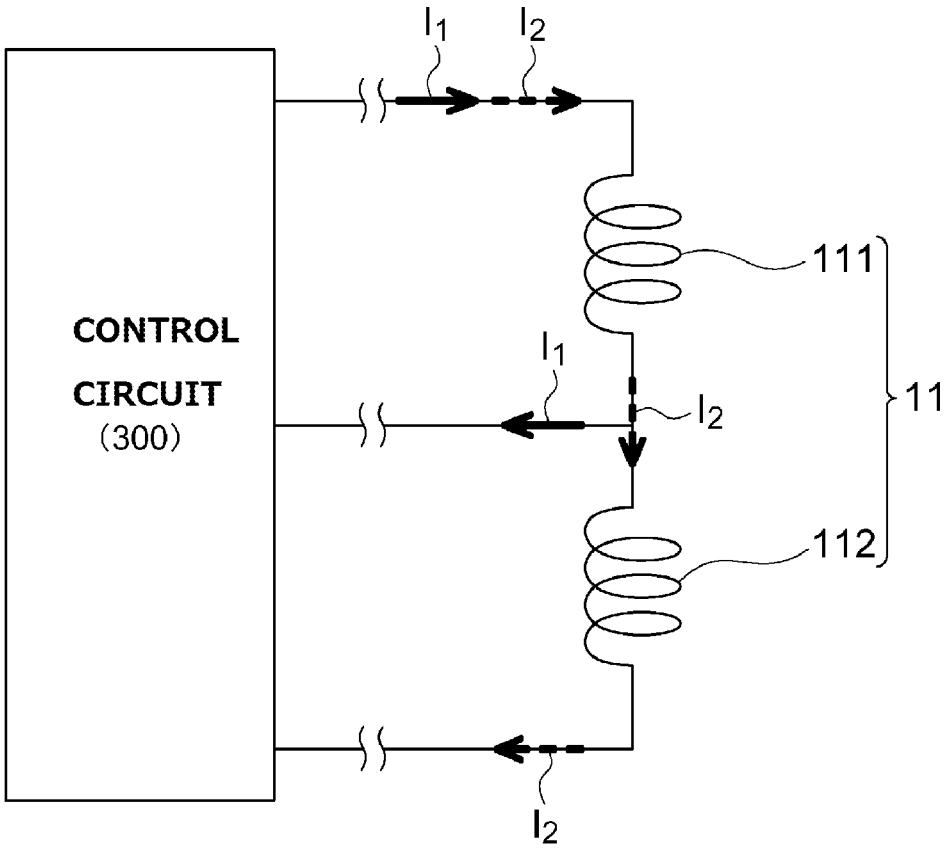
FIG. 4 Is an equivalent circuit of the coil and the control circuit shown in FIG. 3.

Now, description is given of the operation of the relay switch 100 with reference to FIGS. 3 and 4. FIG. 4 shows an equivalent circuit of the coil 11 and the control circuit 300, illustrating a series circuit of the coil 111 and coil 112. In a state where the movable contact 33 and fixed contact 32 are separated, a contact current (I1) is supplied to the coil 111, whereas the contact current (I1) will not be supplied to the coil 112. The contact current (I1) is a minimal current that, when allowed to pass the coil 111, drives the shaft 34 to cause at least portion between the fixed contact 32 and the movable contact 33 to contact.

When the coil 11 is supplied with the contact current (I1), although the coil 112 will not be magnetized, the coil 111 is magnetized to produce a small force (P1) to the shaft 34 and the movable core 18 is attracted to the fixed core 17 to move the shaft 34 in the axial direction to thereby allow the movable contact 33 to contact the fixed contact 32. Then, by detecting by the control circuit 300 connected to both the coil 111 and the coil 112 the current or the like between the coil 111 and the control circuit 300, the continuity of the coil 111 is confirmed. Thereafter, the holding current (I2) will be supplied to the coil 111 and the coil 112. Note that the holding current (I2) is a previously set current to hold or maintain the contact condition between the fixed contact 32 and the movable contact 33, and, by further strengthening the contact or attracting between the fixed contact 32 and the movable contact 33, the ON state of the relay switch 100 will be maintained on the continuous basis. The magnitude of the holding current (I2) may be the same as the contact current (I1).

Since, when the holding current (I2) flows through the coil 111 and coil 112, both the coil 111 and coil 112 are energized, as compared with the case where the contact current (I1) flows coil 111 only, the magnetic flux applied which acts with the magnetic circuit of the relay switch 100 will be stronger. Thus, a large driving force (P2) are generated in the shaft 34, the contact pressure between the movable contact 33 and the fixed contact 32 will be larger as compared to the case where the contact current (I1) is supplied to the coil 111 only. Therefore, after the contact of the movable contact 33 with the fixed contact 32, the holding force between the fixed contact 32 and the movable contact 33 will be increased.

As described above, in the present embodiment, the coil 11 is composed of a plurality of coils 111 and 112. By supplying the coil 111 with the contact current (I1) to thereby energize the coil 111, a driving force (P1) is generated, while by supplying a holding current (I2) both the coil 111 and the coil 112 to thereby energize both coils 111, 112, a driving force (P2) will be generated. Thus, the driving force is not necessarily be changed by controlling the current value to thereby change the driving force of the shaft 34. Therefore, it is possible to prevent the circuit structure of the control circuit 300 from being complicated.

Further, in the present embodiment, the current to be supplied to the coil 11 may be set constant. Thus, without changing the current value, when turning the relay switch 100 on, the collision energy generated between the fixed contact 32 and movable contact 33 may be suppressed.

Further, in the present embodiment, the coil 112 is disposed outside of the coil 111 in such a way that the axis of the coil 111 and that of the coil 112 are aligned with the axis of the shaft 34. Thus, it is possible to easily control the speed of the movable shaft 34 since the electromagnetic force may be applied within the movable range of the shaft 34.

Further, in the present embodiment, the axial length of the coil 111 and that of the coil 112 are configured to be equal. Thus, it is possible to easily control the speed of the movable shaft 34 since the electromagnetic force may be applied within the movable range of the shaft 34.

Note that, in the present embodiment, the shaft 134 may be imparted by the driving force (P1) through current supply to the outside coil 112. Thus, since the coil 112 is located outside of the coil 111 and thus remote with respect to the magnetic circuit, to supply the same contact current (I1) to the coil 111, the driving force may made smaller so that the conflict energy be suppressed.

Note that the coil 11 is not necessarily composed of two coils, but may be composed of three or more coils. Further, the axial length of the coil 111 and that of the coil 112 do not have to be the same.

The "shaft 34" corresponds to the "movable shaft" according to the present invention and the coil 111 and coil 112 correspond to the "plurality of coils".

Figure 5:
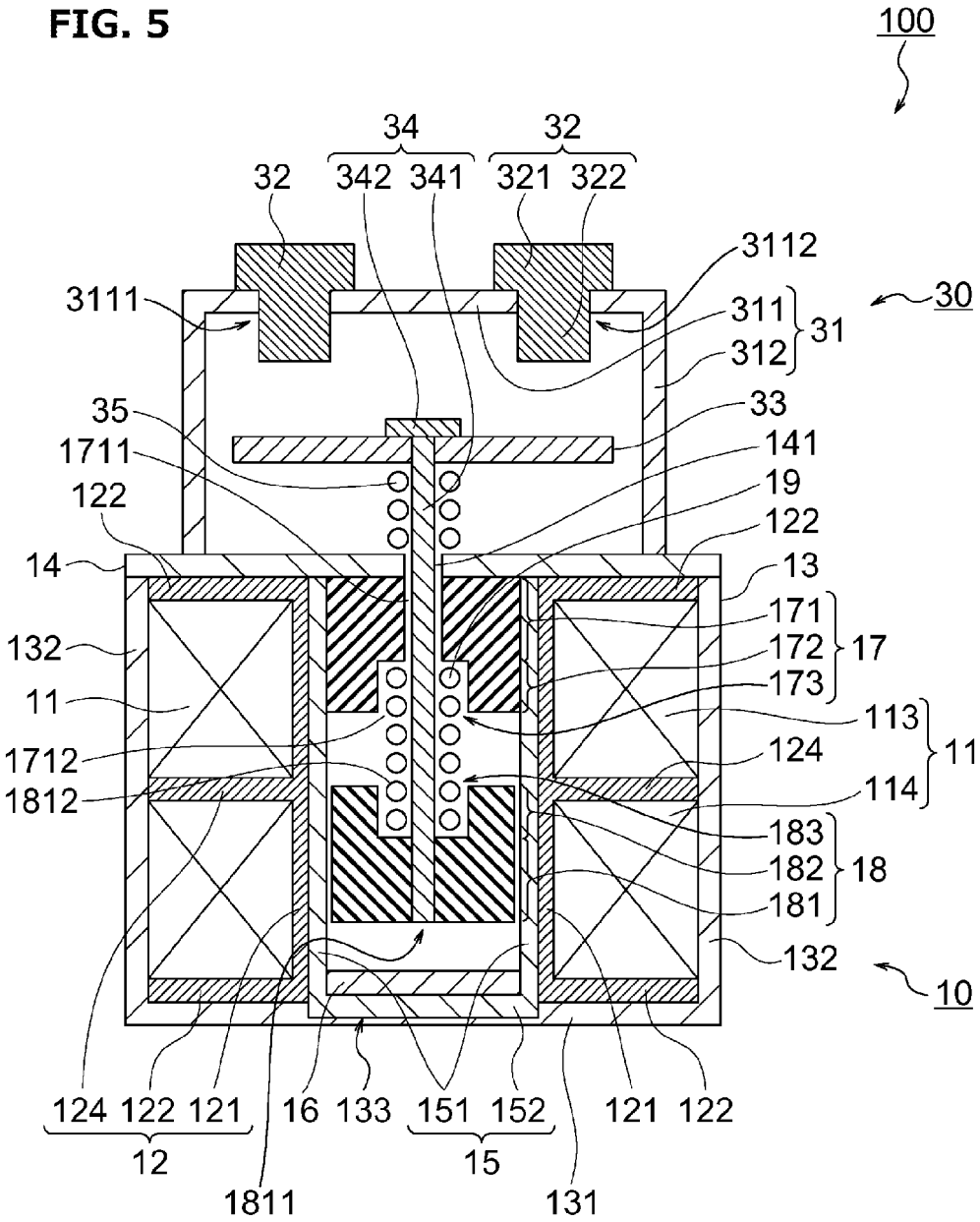
FIG. 5 is a cross-sectional view of the relay switch pertaining still another embodiment according to the present invention.

FIG. 5 is a cross-sectional view of the relay switch according to another embodiment of the present invention. Compared to the first embodiment described above, the configuration of the coil 11 and the bobbin 12 is different. The other configurations are the same as the first embodiment described above, which is incorporated according to the first and second embodiments when appropriate.

As shown in FIG. 5, the coil 11 includes a coil 113 and a coil 114. The coil 113 and the coil 114 are disposed so that each axis is aligned with the axis of the shaft portion 341 of the shaft 34. The coil 113 is disposed on the upper side of the coil with respect to the axial direction of the axis, and is sandwiched between the upper plate portion 122 f the bobbin 12 and the plate portion 124. The coil 114 is sandwiched between the plate portion 124 and the lower plate portion 122. The coil 113 is disposed closer to the movable contact 33 than the coil 114 while the coil 114 is disposed farther from the movable contact 33 than the coil 113.

The bobbin 12 includes a wall portion 121, a pair of plate portions 122, and a plate portion 124. Between the pair of plate portions 122, the plate portion 124 is disposed parallel to the plate portion 122. Between the upper plate portion 122 and the plate portion 124 is provided a space for accommodating the coil 113. Between the lower plate portion and the plate portion 124, a space for receiving the coil 114 is provided.

Now, description is made of the operation of the relay switch 100 with reference to FIG. 5. When a contact current (I1) is supplied to the coil 114 in a state whereas the fixed contact 32 and the movable contact 33 are separated while withholding to supply the contact current (I1) to the coil 113. The contact current (I1) is a minimal current that, when allowed to pass the coil 111, drives the shaft 34 to cause at least portion between the fixed contact 32 and the movable contact 33 to contact.

When the coil 114 is supplied with the contact current, although the coil 113 will not be magnetized, the coil 114 is magnetized to produce a small force (P1) to the shaft 34 and the movable core 18 is attracted to the fixed core 17 to move the shaft 34 in the axial direction to thereby allow the movable contact 33 to contact the fixed contact 32. Then, by detecting by the control circuit 300 connected to both the coil 114 and the coil 113 the current or the like between the coil 114 and the control circuit 300, the continuity of the coil 114 is confirmed. Thereafter, the holding current (I2) will be supplied to the coil 113 and the coil 114. Note that the holding current (I2) is a previously set current to hold or maintain the contact condition between the fixed contact 32 and the movable contact 33, and, by further strengthening the contact or attracting between the fixed contact 32 and the movable contact 33, the ON state of the relay switch 100 will be maintained on the continuous basis. The magnitude of the holding current (I2) may be the same as the contact current (I1).

Since, when the holding current (I2) flows through the coil 113 and coil 114, both the coil 113 and coil 114 are energized, as compared with the case where the contact current (I1) flows coil 114 only, the magnetic flux applied which acts with the magnetic circuit of the relay switch 100 will be stronger. Thus, a large driving force (P2) are generated in the shaft 34, the contact pressure between the movable contact 33 and the fixed contact 32 will be larger as compared to the case where the contact current (I1) is supplied to the coil 114 only. Therefore, after the contact of the movable contact 33 with the fixed contact 32, the holding force between the fixed contact 32 and the movable contact 33 will be increased.

As described above, in the present embodiment, the coil 113 and the coil 114 are disposed side by side in the axial direction with the axis of the coil 113 and that of the coil 114 aligned with the axis with the shaft 34. Thus, it is possible to easily control the speed of the movable shaft 34 since the electromagnetic force may be applied within the movable range of the shaft 34.

Note that, in the present embodiment, by supplying current to the upper side coil 113 in the axial direction, the driving force (P1) is generated to obtain the same effect.

The coil 113 and the coil 114 correspond to the "plurality of coils" according to the present invention.

Figure 6:
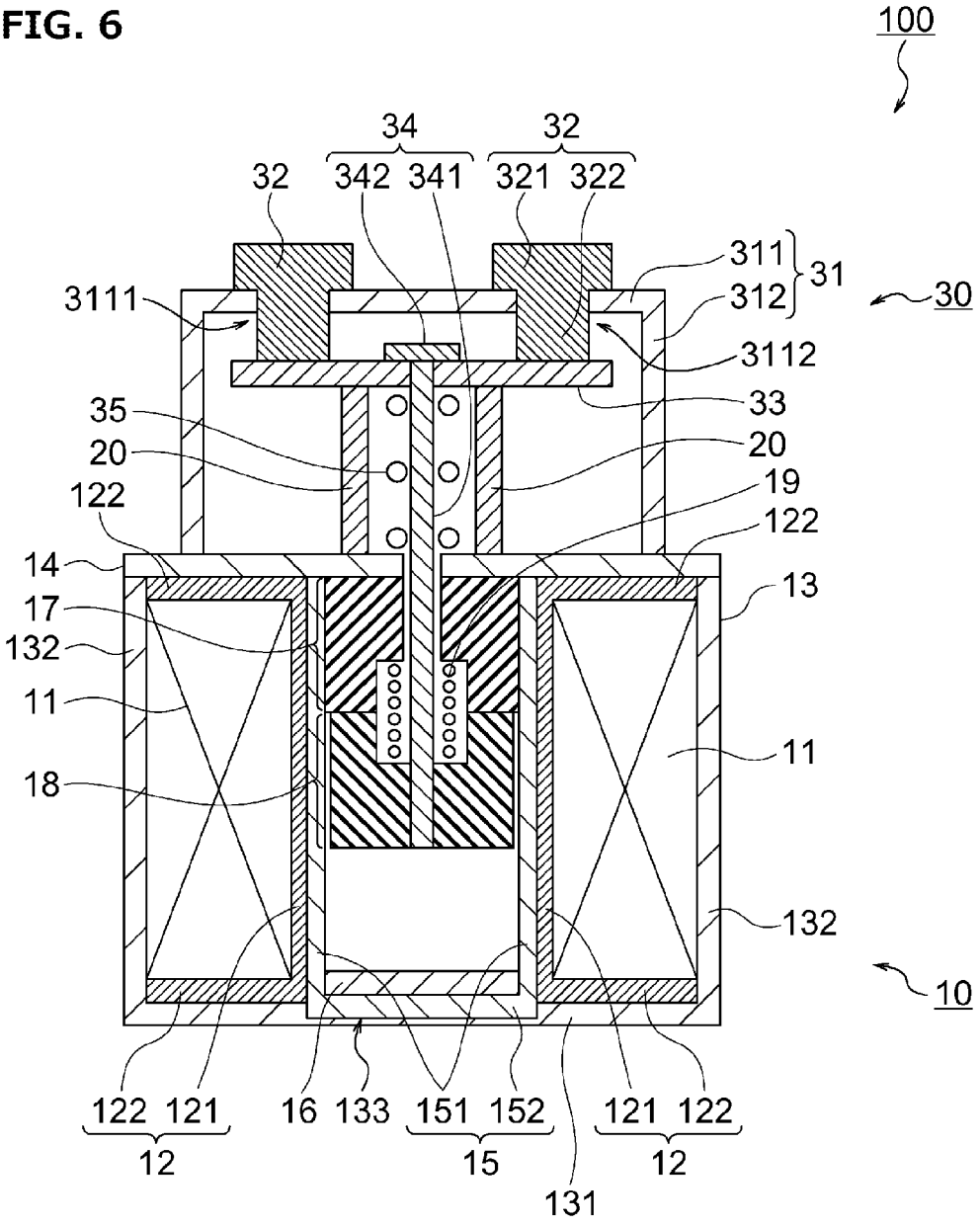
FIG. 6 is a cross-sectional view of the relay switch pertaining to yet another embodiment according to the present invention.

FIG. 6 is a cross-sectional view of the relay switch according to yet another embodiment of the present invention. The point in difference from the first embodiment described above resides in that the driving force (P2) is generated by n actuator 20. Other configurations than this is the same as the first embodiment so that the descriptions in the first to third embodiments may incorporated when appropriate. Note that FIG. 6 shows a cross-sectional diagram in the state where the fixed contact 32 and the movable contact 33 are in contact with each other.

As shown in FIG. 6, the drive unit 10 includes an actuator 20. The actuator is provided in the space formed by the top plate 311, the wall portion 312 and the upper plate 14, and is disposed between the movable contact 33 and top plate 14. The actuator 20 serves as a pressing member to pressurize the movable contact 33 in the axial direction of the shaft 34. The actuator 20 is formed in a cylindrical shape so as to cover the shaft 34 and the contact pressure spring 35 with a predetermined interval. The actuator 20 is configured to expand or contract in the axial direction of the shaft to generate a stress in the axial direction of the shaft 34.

The actuator is connected to a control circuit (not shown) for controlling the relay switch of the present embodiment, and is driven by a signal from the control circuit to push up the movable contact 33 toward the fixed contact 32. The driving force (P2) to the movable contact 33 and the shaft 34 by the actuator 20 is a larger force that the driving force (P1) that generates in response to the contact current (I1) being supplied to the coil 11.

In the off-state of the relay actuator 200 opposing the movable contact 33 switch, i.e., in the state where the fixed contact 32 and the movable contact 33 are free from contact, the actuator 20 does not produce the driving force (P2), the top end of the actuator 20 opposing the movable contact 33 lowers in the axial direction of the shaft 34 so as to approach the top plate 14. Thus, the movable contact will be separated from the fixed contact 32.

Now, description will be given of the operation of the relay switch 100. In a state where no current is supplied to the coil 11, the fixed contact 32 and the movable contact 33 are opposed with a gap in between. First, in the state in which the fixed contact 32 and the movable contact 33 are separated from each other, a contact current (I1) is supplied to the coil 11. The contact current (I1) is the minimum current that is allowed to drive the shaft 34 is set to establish at least a partial contact between the movable contact 33 and fixed contact 32. The contact current (I1) does not present a sufficient current value to continuously hold the ON state of the relay switch 100.

When the contact current (I1) is caused to flow in the coil 11, the coil 11 is energized and the driving force (P1) is generated. The movable iron core 18 is attracted to the fixed core 17 and is fixed to the movable iron core 18. At this point, the actuator 20 is not generating a stress.

Then, after a control circuit (not shown) connected to the coil 11 has confirmed the continuity of the coil 11 by detecting a voltage or the like of the wiring between the coil 11 and the control circuit, the control circuit causes the actuator 20 to be driven. The actuator 20 generates a driving force (P2) to strengthen the attracting force between the fixed contact 33 and the movable contact 33 to maintain the ON-state 100.

When the actuator 20 is driven, the contact pressure between the movable contact 33 and the fixed contact 32 is set larger compared to the contact pressure at the time where the contact current (I1) is supplied to the coil 11 to drive the movable contact 33 by the driving force (P1) only. Thus, after the movable contact 33 has contacted the fixed contact 32, the holding force of the fixed contact 32 and the movable contact 33 will be larger.

As described above, in the present embodiment, by setting the current to be supplied to the coil 11 and energize both the fixed core 17 and the movable core 18, to thereby drive the movable contact 33 so as for the movable contact 33 to come to contact with the fixed contact 32, the movable contact 33 and the fixed contact 32 are brought into contact by the driving force (P1). Further, by the driving force (P2) of the actuator 20, the contact state of the movable contact 33 and the fixed contact 32 is maintained. Thus, when the movable contact 33 and the fixed contact 32 come into contact, the contact pressure between the movable contact 33 and the fixed contact 32 is small, whereas, after contact between the movable contact 33 and the fixed contact 32, the contact pressure is allowed to be increased. Therefore, when turning on the relay switch 100, the impact energy generated between the movable contact 33 and the fixed contact 32 may be suppressed.

Further, after the fixed contact 32 is in contact with the movable contact 33, since the contact between the fixed contact 32 and movable contact 33 is held by the driving force (P2), for example, it is possible to prevent the contact portions to separate due to the vibration or shock that is received while the vehicle is running. As a result, it is possible to prevent temperature rise of the contact portions or adhesion of the contacts due to occurrence of separation of the contact portions.

Note that in the present embodiment, the actuator may be formed in a mechanism driven by hydraulic pressure, a mechanism driven by an air pressure, or a mechanism that is driven by a mechanism driven by an internal motor. The actuator 20 described above corresponds to the "drive means" according to the present invention.

The invention claimed is:

1. An electromagnetic relay, comprising:

a fixed contact;

a movable contact for selectively contacting with or separating from the fixed contact; and a drive unit having at least an electromagnetic coil unit having a plurality of coils for driving the movable contact so as to come into contact with the fixed contact, wherein the drive unit is configured to generate a first driving force to cause the movable contact to contact the fixed contact and a second driving force greater than the first driving force to hold a contact state between the movable contact and the fixed contact, wherein after the movable contact and the fixed contact have contacted, the second driving force is caused to be generated from the first driving force, the first driving force generated by supplying current through a portion of the plurality of coils and the second driving force generated by supplying current to all of the plurality of coils.

2. The electromagnetic relay as claimed in claim 1, further comprising:

a movable shaft for selectively contacting or separating the movable contact and the fixed contact, wherein the electromagnetic coil unit has an axis aligned with an axis position of the movable shaft; and one coil of the plurality of coils is disposed inside of another coil of the plurality of coils.

3. The electromagnetic relay as claimed in claim 1, further comprising:

a movable shaft for selectively contacting and separating the movable contact and the fixed contact, wherein the electromagnetic coil unit has an axis of the plurality of coils aligned with an axis of the movable shaft, and the coils of the plurality of coils are disposed side by side in an axial direction.

4. An electromagnetic relay comprising:

a fixed contact;

a movable contact for contacting the fixed contact; and a drive unit having at least an electromagnetic coil unit having a plurality of coils for driving the movable contact so as to come into contact with the fixed contact, wherein the drive unit is configured to generate a first driving force to cause the movable contact to contact the fixed contact and a second driving force greater than the first driving force to hold a contact state between the movable contact and the fixed contact, wherein the drive unit is configured to generate the first driving force by supplying a first current to the electromagnetic coil and to generate the second drive force by supplying a second current greater than the first current, the first driving force generated by supplying current through a portion of the plurality of coils and the second driving force generated by supplying current to all of the plurality of coils.

5. An electromagnetic relay comprising:

a fixed contact;

a movable contact for contacting the fixed contact;

a drive unit having at least an electromagnetic coil unit having a plurality of coils for driving the movable contact so as to come into contact with the fixed contact; and a movable shaft for selectively contacting and separating the movable contact and the fixed contact, an axis of the plurality of coils aligned with an axis of the movable shaft, wherein the drive unit is configured to generate a first driving force to cause the movable contact to contact the fixed contact and a second driving force greater than the first driving force to hold a contact state between the movable contact and the fixed contact, wherein the drive unit is configured to generate the first driving force by supplying a first current to the electromagnetic coil and to generate the second drive force by supplying a second current greater than the first current, and wherein the coils of the plurality of coils are disposed side by side in an axial direction or one coil of the plurality of coils is disposed inside of another coil of the plurality of coils.

* * * * *